US009486996B2

(12) United States Patent
Ng et al.

(10) Patent No.: US 9,486,996 B2
(45) Date of Patent: Nov. 8, 2016

(54) GRAVURE PRINTING PROCESS USING SILVER NANOPARTICLE INKS FOR HIGH QUALITY CONDUCTIVE FEATURES

(71) Applicants: Xerox Corporation, Norwalk, CT (US); Palo Alto Research Center Incorporated, Palo Alto, CA (US)

(72) Inventors: Tse Nga Ng, Sunnyvale, CA (US); Brent S. Krusor, Fremont, CA (US); Adela Goredema, Ancaster (CA); Yiliang Wu, San Ramon, CA (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 20 days.

(21) Appl. No.: 14/630,899

(22) Filed: Feb. 25, 2015

(65) Prior Publication Data

US 2016/0243816 A1 Aug. 25, 2016

(51) Int. Cl.

| | |
|---|---|
| ***B41F 23/04*** | (2006.01) |
| ***B41F 5/24*** | (2006.01) |
| ***B41M 1/10*** | (2006.01) |
| ***B41C 1/00*** | (2006.01) |
| ***B41F 31/00*** | (2006.01) |

(52) U.S. Cl.

CPC ..... *B41F 23/04* (2013.01); *B41C 1/00* (2013.01); *B41F 5/24* (2013.01); *B41F 31/00* (2013.01); *B41M 1/10* (2013.01)

(58) Field of Classification Search

CPC ..... B41F 5/24; B41F 23/04; B41F 31/00; B41C 1/00; B41M 1/10

See application file for complete search history.

(56) References Cited

U.S. PATENT DOCUMENTS

| | | | | |
|---|---|---|---|---|
| 5,174,925 | A * | 12/1992 | Fujii | C09D 11/52 252/514 |
| 7,270,694 | B2 | 9/2007 | Li et al. | |
| 7,977,240 | B1 * | 7/2011 | Rockenberger | C09D 11/52 257/E21.273 |
| 8,240,250 | B2 | 8/2012 | Boettcher | |
| 8,765,025 | B2 | 7/2014 | Wu et al. | |
| 2003/0151028 | A1 * | 8/2003 | Lawrence | C09D 11/52 252/500 |
| 2008/0182011 | A1 * | 7/2008 | Ng | B82Y 10/00 427/99.4 |
| 2009/0282994 | A1 * | 11/2009 | Kubert | B41M 1/04 101/142 |
| 2011/0305821 | A1 * | 12/2011 | Wu | C09D 5/24 427/58 |
| 2014/0312284 | A1 | 10/2014 | Liu et al. | |

OTHER PUBLICATIONS

Naveen Chopra, et al., U.S. Appl. No. 14/188,284, filed Feb. 24, 2014, "High Silver Content Nanosilver Ink for Gravure and Flexographic Printing Applications," not yet published.

Adela Goredema, et al., U.S. Appl. No. 14/573,191, filed Dec. 17, 2014, "Nanosilver Ink Compositions Comprising Clay Additives," not yet published.

Adela Goredema, et al., U.S. Appl. No. 14/594,746, filed Jan. 12, 2015, "Nanosilver Ink Compositions Comprising Polystyrene Additives," not yet published.

* cited by examiner

*Primary Examiner* — Matthew G Marini
*Assistant Examiner* — Marissa Ferguson Samreth
(74) *Attorney, Agent, or Firm* — Marylou J. Lavoie, Esq. LLC

(57) ABSTRACT

A process including selecting a printing system; selecting an ink composition having ink properties that match the printing system; depositing the ink composition onto a substrate to form an image, to form deposited features, or a combination thereof; optionally, heating the deposited features to form conductive features on the substrate; and performing a post-printing treatment after depositing the ink composition.

20 Claims, 6 Drawing Sheets

FIRST PASS

SECOND PASS

INK WITH DRAG-OUT ISSUE

GRAVURE PRINTING PROCESS USING SILVER NANOPARTICLE INKS FOR HIGH QUALITY CONDUCTIVE FEATURES

BACKGROUND

Disclosed herein is a process comprising selecting a printing system; selecting an ink composition having ink properties that match the printing system; depositing the ink composition onto a substrate to form an image, to form deposited features, or to form a combination thereof; optionally, heating the deposited features to form conductive features on the substrate; and performing a post-printing treatment after depositing the ink composition.

Xerox Corporation has invented a nanosilver particle which is stabilized by an organoamine. U.S. Pat. No. 8,765,025, which is hereby incorporated by reference herein in its entirety, describes a metal nanoparticle composition that includes an organic-stabilized metal nanoparticle and a solvent in which the solvent selected has the following Hansen solubility parameters: a dispersion parameter of about 16 $MPa^{0.5}$, or more, and a sum of a polarity parameter and a hydrogen bonding parameter of about 8.0 $MPa^{0.5}$ or less. U.S. Pat. No. 7,270,694, which is hereby incorporated by reference herein in its entirety, describes a process for preparing stabilized silver nanoparticles comprising reacting a silver compound with a reducing agent comprising a hydrazine compound by incrementally adding the silver compound to a first mixture comprising the reducing agent, a stabilizer comprising an organoamine, and a solvent.

U.S. patent application Ser. No. 13/866,704, which is hereby incorporated by reference herein in its entirety, describes stabilized metal-containing nanoparticles prepared by a first method comprising reacting a silver compound with a reducing agent comprising a hydrazine compound by incrementally adding the silver compound to a first mixture comprising the reducing agent, a stabilizer comprising an organoamine, and a solvent. U.S. patent application Ser. No. 14/188,284, which is hereby incorporated by reference herein in its entirety, describes conductive inks having a high silver content for gravure and flexographic printing and methods for producing such conductive inks.

Xerox Corporation has developed flexographic and gravure inks based on silver nanoparticle technology. U.S. patent application Ser. No. 14/594,746, which is hereby incorporated by reference herein in its entirety, describes in the Abstract thereof a nanosilver ink composition including silver nanoparticles; polystyrene; and an ink vehicle. A process for preparing a nanosilver ink composition is described comprising combining silver nanoparticles; polystyrene; and an ink vehicle. A process for forming conductive features on a substrate using flexographic and gravure printing processes is described comprising providing a nanosilver ink composition comprising silver nanoparticles; polystyrene; and an ink vehicle; depositing the nanosilver ink composition onto a substrate to form deposited features; and heating the deposited features on the substrate to form conductive features on the substrate.

U.S. patent application Ser. No. 14/573,191, which is hereby incorporated by reference herein in its entirety, describes in the Abstract thereof a nanosilver ink composition including silver nanoparticles; a clay dispersion; and an ink vehicle. A process for forming conductive features on a substrate is described including providing a nanosilver ink composition comprising silver nanoparticles; a clay dispersion; and an ink vehicle; depositing the nanosilver ink composition onto a substrate to form deposited features; and heating the deposited features on the substrate to form conductive features on the substrate. Inks have been successfully formulated in non-polar solvents such as decalin and bicyclohexyl and successfully printed using inkjet printing technologies. As printed electronics matures and moves to higher volume production, it is desirable to have inks that can be used in offset printing technologies such as flexography and gravure. Offset printing technologies provide established printing processes and equipment. FIG. 1 shows a schematic diagram of a flexographic printing process. Flexographic printing processes generally comprise the following steps: a) anilox roller 100 having metered anilox cells 112 picks up ink from the ink pan 114; b) doctor blade 116 scrapes off excess ink; c) ink is then deposited on to the flexo-plate 118; d) flexo plate 118 and plate cylinder 120 transfer features onto the substrate (material web) 122 shown exiting impression cylinder 124.

A gravure printing process is very similar to flexography except that it does not have an anilox roller and the image is engraved onto a metal cylinder. This makes gravure more expensive than flexo and high volume printing. One of the main advantages of gravure over flexo is the ability to consistently make high quality prints. FIG. 2 shows a schematic diagram of a gravure printing process. Gravure processes generally comprise the following steps: a) plate 200 comprising plate cylinder 212 picks up ink 214 from the ink pan; b) doctor blade 216 scrapes off excess ink; c) ink is then transferred from the plate cylinder 212 to the substrate (paper) 218 shown exiting impression cylinder 220 having printed image 222 printed thereon.

Gravure and flexographic processes provide a potentially efficient way to manufacture a number of conductive components at a lower cost than that of other printing applications. However, such processes require different processing parameters than conventional graphics printing, particularly for electronics applications.

A need remains for improved printing processes, in embodiments, for improved gravure and flexographic printing processes. Further, a need remains for an improved printing process for printed graphics and printed electronics applications. Further, a need remains for a reliable gravure printing process that can be used for printed electronics applications.

The appropriate components and process aspects of each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a process comprising selecting a printing system; selecting an ink composition having ink properties that match the printing system; depositing the ink composition onto a substrate to form an image, to form deposited features, or a combination thereof; optionally, heating the deposited features to form conductive features on the substrate; and performing a post-printing treatment after depositing the ink composition.

Also described is a process comprising selecting a printing system; selecting an ink composition having ink properties that match the printing system; depositing the ink composition onto a substrate to form deposited features; performing a post-printing treatment after depositing the ink composition; and heating the deposited features to form conductive features on the substrate.

DETAILED DESCRIPTION

Figure 1:
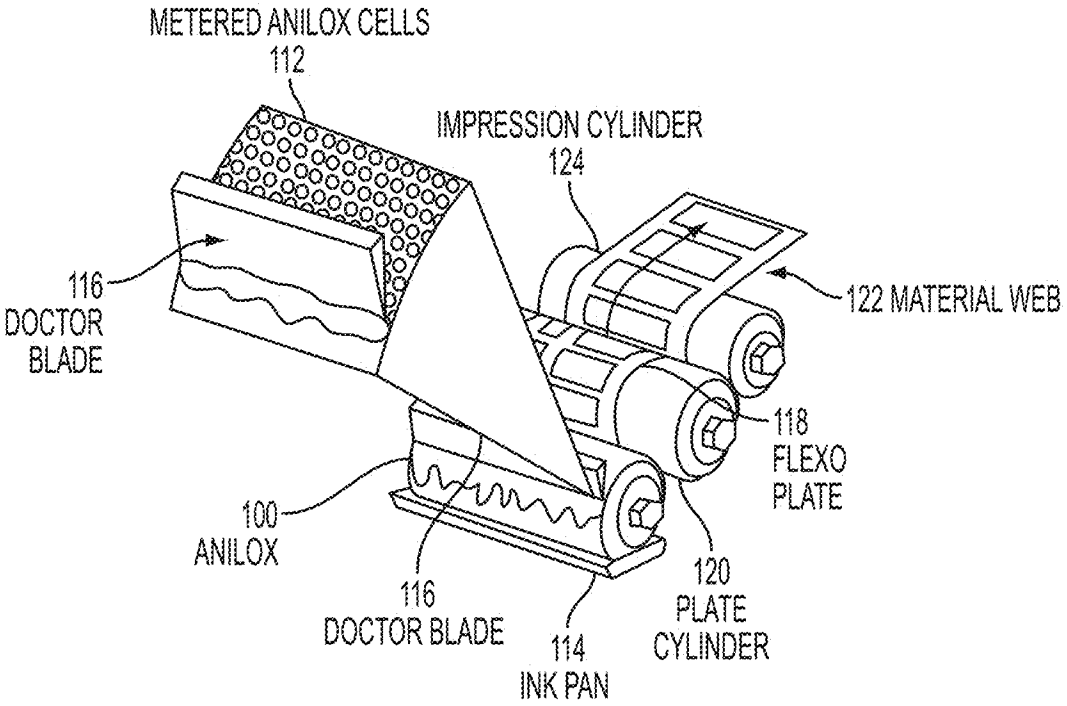
FIG. 1 is a schematic diagram of a flexographic printing process.
Figure 2:
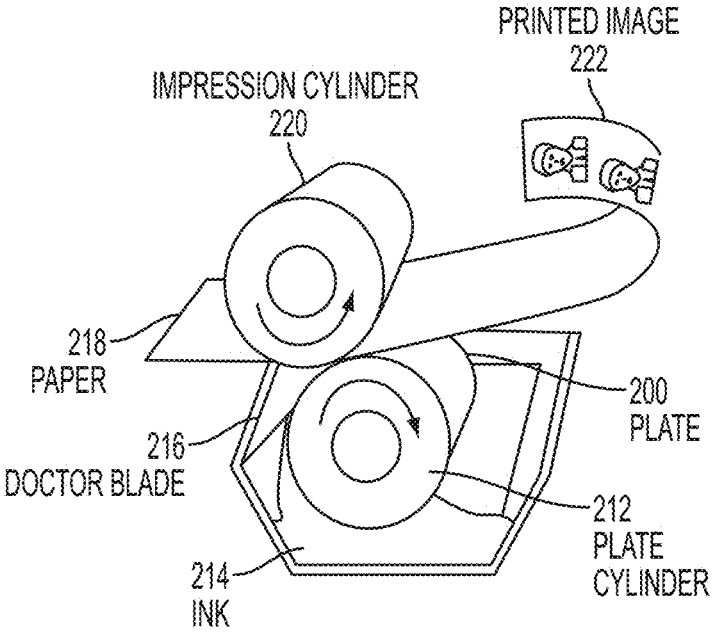
FIG. 2 is a schematic diagram of a gravure printing process.

Gravure printing for electronics applications requires different processing parameters than conventional graphics printing. To achieve fewer defective conductive features with gravure printing, the process herein comprises matching ink properties with the printer system. In embodiments, post printing treatment may be employed to enhance the quality of the prints.

In embodiments, a process is provided comprising selecting a printing system; selecting an ink composition having ink properties that match the printing system; depositing the ink composition onto a substrate to form an image, to form deposited features, or to form a combination thereof; optionally, heating the deposited features, if they were formed, to form conductive features on the substrate; and performing a post-printing treatment after depositing the ink composition. In certain embodiments, a process is provided comprising selecting a printing system; selecting an ink composition having ink properties that match the printing system; depositing the ink composition onto a substrate to form deposited features; heating the deposited features to form conductive features on the substrate; and performing a post-printing treatment after depositing the ink composition. In a specific embodiments, a gravure printing process using metal nanoparticle inks for preparing high quality conductive features is provided.

Print resolution and consistency are dependent on the interaction between ink rheology and printer setup parameters. For printing electronic features, the constraints for printed line continuity (opens) and background haze (shorts) impose additional processing requirements different from conventional graphic prints. In embodiments, the present process provides a range of processing windows tailored for nanoparticle inks based on organic solvent systems. In embodiments, the ink properties are matched to the gravure printer setup to optimize print resolution, reproducibility, and electrical characteristics.

Thus, the process herein encompasses properly matching ink rheology to the printer system to achieve conductive features with optimal printed quality including print resolution, reproducibility, and electrical characteristics.

The process can be employed with any suitable or desired printing system or printing technology. In embodiments, the process comprises selecting a printing system comprising a flexographic printing system or a gravure printing system. For example, in embodiments, a flexographic printing process can be selected and an ink composition selected for use with the particular flexographic printing system. A flexographic printing process generally comprises the following steps: a) using an anilox roller having metered anilox cells to pick up ink from an ink supply such as an ink pan; b) optionally, using a doctor blade to scrape off excess ink; c) depositing ink on to a flexographic plate; d) transferring the deposited ink from the flexographic plate onto a substrate, such as a material web.

In further embodiments, a gravure printing process can be selected and an ink composition selected for use with the particular gravure printing process. A gravure printing process generally comprises the following steps: a) using a plate to pick up ink from an ink supply such as an ink pan; b) optionally, scraping off excess ink with a doctor blade; c) transferring the ink from a plate cylinder to a substrate (such as paper); exiting the substrate from an impression cylinder having a printed image printed thereon.

In embodiments, the ink composition is deposited in a single pass.

In embodiments, the process comprises post-printing treatment of the deposited ink image or conductive features. Any suitable or desired post-printing treatment can be selected. In embodiments, the post-printing treatment comprises sintering, etching, or a combination thereof. In a specific embodiment, the post-printing treatment comprises sintering. In another specific embodiment, the post-printing treatment comprises etching.

Sintering and etching can be carried out by any suitable or desired method as is known in the printing and printed electronics arts. In embodiments, a dilute Ag etchant, such as a Transene semiconductor and thin film etchant available from Transene Company, Inc., http://transene.com/ag-etchant/) in a 1:50 etchant-to-water ratio. Other etchants suitable for printed metal can also be selected.

The post-printing treatment can be done at any suitable or desired time in the process. In embodiments, the post-printing treatment is done after depositing the ink to form the image or deposited feature but before heating the deposited feature to form the conductive feature(s). In embodiments, the post-printing treatment is done after heating the deposited feature.

The process can be used to produce printed graphic images, conductive features for printed electronics applications, or a combination thereof. The process herein provides an improved gravure and flexographic printing process that is particularly advantageous for printed electronics applications. Further, the process provides a reliable gravure printing process that can be used for printed electronics applications.

In a specific embodiment, the printing system selected for the process herein is a gravure printing system and the post-printing treatment comprises sintering, etching, or a combination thereof.

The process can be used to form images or conductive features or a combination thereof. When used for image formation (and not electronics), the subsequent heating step is not required. The fabrication of conductive features, such as an electrically conductive element, can be carried out by depositing the ink composition on a substrate using the selected deposition technique including flexographic and gravure printing processes at any suitable time prior to or subsequent to the formation of other optional layer or layers on the substrate. Thus deposition of a nanosilver ink composition on the substrate can occur either on a substrate or on a substrate already containing layered material, for example, a semiconductor layer and/or an insulating layer.

The substrate upon which the metal features are deposited may be any suitable substrate including silicon, glass plate, plastic film, sheet, fabric, or paper. For structurally flexible devices, plastic substrates such as polyester, polycarbonate, polyimide sheets, and the like, may be used. The thickness of the substrate can be any suitable thickness such as about 10 micrometers to over 10 millimeters with an exemplary thickness being from about 50 micrometers to about 2 millimeters, especially for a flexible plastic substrate, and from about 0.4 to about 10 millimeters for a rigid substrate such as glass or silicon.

Heating the deposited nanosilver ink composition can be to any suitable or desired temperature, such as to from about 70° C. to about 200° C., or any temperature sufficient to induce the metal nanoparticles to "anneal" and thus form an electrically conductive layer which is suitable for use as an electrically conductive element in electronic devices. The heating temperature is one that does not cause adverse changes in the properties of previously deposited layers or the substrate. In embodiments, use of low heating temperatures allows use of low cost plastic substrates which have an annealing temperature of below 200° C.

The heating can be for any suitable or desire time, such as from about 0.01 second to about 10 hours. The heating can be performed in air, in an inert atmosphere, for example under nitrogen or argon, or in a reducing atmosphere, for example, under nitrogen containing from about 1 to about 20 percent by volume hydrogen. The heating can also be performed under normal atmospheric pressure or at a reduced pressure of, for example, about 1000 mbars to about 0.01 mbars. For example, sintering can be carried out by heating the printed substrate to a temperature of from about 100 to about 160° C. for a period of from about 5 to about 30 minutes. If photonic sintering is used, the high power Xenon flash lamp can reduce the sintering time to several seconds to minutes.

Heating encompasses any technique that can impart sufficient energy to the heated material or substrate to (1) anneal the metal nanoparticles and/or (2) remove the optional stabilizer from the metal nanoparticles. Examples of heating techniques include thermal heating (for example, at hot plate, an oven, and a burner), infra-red ("IR") radiation, laser beam, flash light, microwave radiation, or ultraviolet ("UV") radiation, or a combination thereof.

In embodiments, after heating, the resulting electrically conductive line has a thickness ranging from about 0.1 to about 20 micrometers, or from about 0.15 to about 10 micrometers. In certain embodiments, after heating, the resulting electrically conductive line has a thickness of from about 0.25 to about 5 micrometers.

In, embodiments, the ink composition herein has a bulk conductivity that is more than about 50,000 S/cm. The conductivity of the resulting metal element produced by heating the deposited nanosilver ink composition is, for example, more than about 100 Siemens/centimeter (S/cm), more than about 1,000 S/cm, more than about 2,000 S/cm, more than about 5,000 S/cm, more than about 10,000 S/cm, or more than about 50,000 S/cm.

The resulting elements can be used for any suitable or desired application, such as for electrodes, conductive pads, interconnects, conductive lines, conductive tracks, and the like, in electronic devices such as thin film transistors, organic light emitting diodes, RFID tags, photovoltaic, displays, printed antenna, and other electronic devise which required conductive elements or components.

By matching the ink properties to the selected printing system, the process herein provides optimal printed features. Any suitable or desired ink composition can be selected for the process provided that the ink composition is selected to match the selected printing system. By selecting to match the selected printing system, it is meant that the ink is selected to optimize the performance of the ink and the printing system to produce a high quality image, and in particular embodiments, a high quality conductive feature. The characteristics of the ink, boiling point, viscosity, drying time, etc., are selected based on the printing system.

In embodiments, selecting an ink composition having ink properties that match the printing system comprises selecting an ink composition having a viscosity that matches the printing system. For example, an ink having a viscosity of from about 15 to about 100 centipoise at about 25° C. is matched with an Accupress® 1 open reservoir gravure printing system from Ohio Gravure Technologies (formerly Daetwyler R&D Corp.).

In embodiments, selecting an ink composition having ink properties that match the printing system comprises selecting an ink composition having a boiling point that matches the printing system. For example, an ink having a boiling point of from about 200 to about 250° C. is matched with a printing system having an open enclosure ink reservoir. Alternatively, an ink having a boiling point of from about 80 to about 190° C. is matched with a printing system having a closed enclosure ink reservoir.

In embodiments, selecting an ink composition having ink properties that match the printing system comprises selecting an ink composition having a relatively low boiling point for a printing system having a closed enclosure ink reservoir. What is meant by a relatively low boiling point ink is that the ink has a boiling point of from about 80 to about 190° C.

A closed enclosure ink reservoir printing system is described in U.S. Pat. No. 8,240,250, which is hereby incorporated by reference herein in its entirety. U.S. Pat. No. 8,240,250 describes in the Abstract thereof an improved ink system for a single pan design of a rotogravure printing press includes: the reservoir enclosing a substantial portion of the gravure cylinder; the intake section bottom having a slope at the bottom of the intake section; an intake port through the bottom of the intake section; and outtake port through the bottom of the outtake section; the outtake section bottom having a slope at the bottom of the outtake section sloping toward the outtake port; a dam release lever connected to the gate and extending outside of the reservoir, a plurality of channels through the vortex promoter; a prewipe bar located between the doctor blade and the vortex promoter; journal port seals located on each side of the gravure cylinder; and an angled doctor blade holder.

In embodiments, selecting an ink composition having ink properties that match the printing system comprises selecting an ink composition having a relatively high boiling point for a printing system having an open enclosure ink reservoir.

What is meant by a relatively high boiling point ink is that the ink has a boiling point of from about 200 to about 250° C. An example of an open enclosure ink reservoir printing system is an Accupress® 1 open reservoir gravure printing system from Ohio Gravure Technologies (formerly Daetwyler R&D Corp.).

In embodiments, an ink is selected having a drying time that matches the printing system. For example, fast drying ink can be defined as an ink composition having a drying curve with a slope of less than 1.5. For a closed enclosure ink reservoir type printing system, a fast drying ink is selected.

A slow drying ink can be defined as an ink composition having a drying curve with a slope of more than 2. For an open enclosure ink reservoir type printing system, a slow drying ink is selected.

Thus, the boiling point and drying characteristics of the ink composition can be selected to match the printing system. For example, for an open system, an ink having a relatively high boiling solvent system with slow drying time may be selected. For a closed system, an ink having a relatively low boiling solvent system and a fast drying time may be selected.

The ink composition can be a metal nanoparticle containing ink composition. In embodiments, the ink composition comprises metal nanoparticles, polystyrene, and an ink vehicle. In embodiments, the ink composition comprises metal nanoparticles, a clay dispersion, and an ink vehicle. In embodiments, the ink vehicle is a solvent or a mixture of solvents.

In embodiments, the ink composition can be a nanosilver ink composition described in U.S. patent application Ser. No. 14/594,746, which is hereby incorporated by reference herein in its entirety, comprising silver nanoparticles; polystyrene; and an ink vehicle. In embodiments, the ink vehicle is a non-polar organic solvent. In embodiments, the ink vehicle is a mixture of decalin and bicyclohexyl.

In embodiments, the ink composition can be a nanosilver ink composition described in U.S. patent application Ser. No. 14/573,191, which is hereby incorporated by reference herein in its entirety, comprising a nanosilver ink composition including silver nanoparticles; a clay dispersion; and an ink vehicle.

Thus, in embodiments, the ink compositions selected for the present process include silver nanoparticle ink containing a viscosity modifier. While the viscosity of Ag electrode precursor ink is increased with a polymer binder to facilitate better print resolution, the binder does not compromise charge injection.

In embodiments, the ink solvent system is matched to the printer reservoir enclosure, to minimize line drag-out while preventing ink clogging in the engraved cells.

In embodiments, the process provides elimination of electric shorts between electrodes by use of a post-printing etching step, which allows higher tolerance on the blade and nip pressure. In embodiments, the process includes the integration of gravure printing with an etching step to further improve the quality of printed conductive features. Printed conductive features were successfully demonstrated as electrodes for p-type thin film transistors.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Preparation of Silver Concentrate. To a jacketed beaker was added decalin (35 grams) (Evonik Industries) and then stirred with a high speed mixer at 2000 RPM. To this was added silver nano paste (200 grams) (91.32% Ash, prepared according to the procedure described in U.S. Pat. No. 7,270,694, which is hereby incorporated by reference herein in its entirety, over 5 minutes allowing the paste to be dispersed by the mixer. After the addition the dispersion was maintained at 20° C. with cold water through the jacketed beaker while bubbling nitrogen through the dispersion. After 6 hours the concentrate was poured into a glass bottle to afford 175 grams of silver concentrate having 79.80% silver content.

Preparation of Poly(4-methylstyrene) Solution in Decalin. Into a clean 50 milliliter beaker were added the following: 2 grams of poly(4-methylstyrene) from Sigma-Aldrich® and 18 grams decalin (99.6% purity) from Evonik Industries. The mixture was stirred at 100° C. for about 1 hour during which the poly(4-methylstyrene) dissolved. The solution was cooled down to room temperature. The solution had a viscosity of 16.85 centipoise at 100 $s^{-1}$.

Ink Examples 1-9 were prepared as described below. The inks of Examples 1-9 had about 65 percent silver, by weight, based on the total weight of the ink. Decalin boiling point is from about 189-to about 191° C. Bicyclohexyl boiling point is about 227° C. Table 1 summarizes the ink formulations with various solvent systems.

Example 1

Preparation of Ink Example 1. To a 120 milliliter plastic bottle was added 48.93 grams of silver concentrate as described above. This was followed by bicyclohexyl solvent (11.16 grams) (Solutia, Eastman Chemical Company). Glass beads (23.46 grams) were added to the mixture. The sample was purged with argon, tightly sealed using 3M® 764 vinyl green tape and roll-milled at 175 RPM for 1.5 hours. Ink rheology was measured using Ares G2 Rheometer from TA instruments using a 40 millimeter cone. A rate sweep was run from 1000 to 4 $S^{-1}$ at 25° C.

Example 2

Ink Example 2 was prepared in the same way as ink Example 1.

Example 3

Preparation of Ink Example 3. To a 30 milliliter plastic bottle was added 1.02 grams of poly(4-methylstyrene) solution as described above. This was followed by 8.29 grams of silver concentrate as described above and 0.71 grams of bicyclohexyl solvent. Glass beads (5.15 grams) were added to the mixture. The sample was purged with argon, tightly sealed using 3M® 764 vinyl green tape and roll-milled at 175 RPM for 1.5 hours. Ink rheology was measured using Ares G2 Rheometer from TA instruments using a 40 millimeter cone. A rate sweep was run from 400 to 4 $S^{-1}$ at 25° C.

Examples 4, 5, 6, and 7

Preparation of Ink Examples 4, 5, 6 and 7. Ink Examples 4, 5, 6 and 7 were prepared in the same way as ink Example 3 except different solvent ratios were used. Table 1 below shows the solvent ratios and ink properties.

Example 8

Preparation of Ink Example 8. To a 125 milliliter plastic bottle was added decalin solvent (7.27 grams), bicyclohexyl solvent (4.85 grams) and glass beads (35.16 grams). Silver powder (44.95 grams, derived from silver nano paste prepared according to the procedure described in U.S. Pat. No. 7,270,694, which is hereby incorporated by reference herein in its entirety) was slowly added to the bottle with shaking. The sample was purged with argon, tightly sealed using 3M® 764 vinyl green tape and roll-milled at 175 RPM for 1 hour. Poly(4-methylstyrene) solution (3.01 grams) was added to the sample. The sample was purged with argon, tightly sealed using 3M® 764 vinyl green tape and roll-milled at 175 RPM for 3 hours. Ink rheology was measured using Ares G2 Rheometer from TA instruments using a 40 millimeter cone. A rate sweep was run from 400 to 4 $S^{-1}$ at 25° C.

Example 9

Ink Example 9 was prepared in the same way as ink Example 8 except different solvent ratios were used. Table 1 below shows the solvent ratios and ink properties.

Table 1 below shows ink compositions, solvent ratios, and some ink properties.

TABLE 1

| Example | Solvent System | Weight % Poly(4-methylstyrene) | *Drying Curve Slope | Viscosity (centipoise) (100 $S^{-1}$) |
|---|---|---|---|---|
| 1 | 0.65:1 Decalin:Bicyclohexyl | 0 | ND | 20.65 |
| 2 | 0.65:1 Decalin:Bicyclohexyl | 0 | 1.4 | ND |
| 3 | 3.2:1 Decalin:Bicyclohexyl | 1 | 2.4 | 25.52 |
| 4 | 4.6:1 Decalin:Bicyclohexyl | 1 | 2.7 | 27.59 |
| 5 | 6:1 Decalin:Bicyclohexyl | 1 | ND. Dried too fast on an open reservoir gravure printing system | 51.20 |
| 6 | 6:1 Decalin:Bicyclohexyl | 1 | 2.8 | Not Determined |
| 7 | 1.6:1 Decalin:Bicyclohexyl | 1 | 1.8 | 32.30 |
| 8 | 2:1 Decalin:Bicyclohexyl | 1 | ND. Dried too fast on an open reservoir gravure printing system | 47.35 |
| 9 | 0.65:1 Decalin:Bicyclohexyl | 1 | Appropriate drying time for an open reservoir gravure printing system | 53.63 |

*Ink drying rate depends on the drying conditions. Samples were dried at room temperature in a fume hood.

By matching the ink properties to the printer system, the process provides optimal printed features. Prints were prepared using an Accupress® 1 from Ohio Gravure Technologies (formerly Daetwyler R&D Corp.) using an open ink reservoir. The cylinder is 150 millimeters in diameter and 420 millimeters in length. The ink reservoir may be modified with an ink pan enclosure to cover a portion of the gravure cylinders as described in U.S. Pat. No. 8,240,250. The process herein encompasses selecting the reservoir design as part of the overall system selection and matching the ink composition selection to both open and closed enclosure systems thus enabling greater flexibility in print system use.

Figure 3:
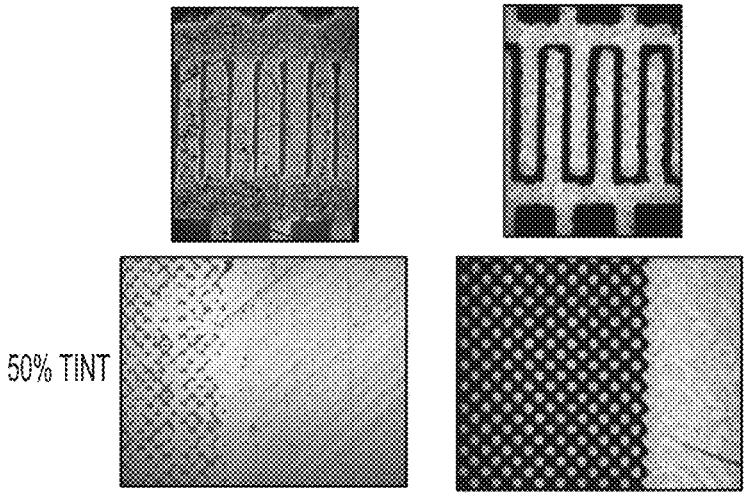
FIG. 3 is a comparison of printed features using an ink without an added polystyrene binder, left side, and an ink with an added polystyrene binder, right side.

The ink viscosity and ink drying rate are selected to match the printing system. FIG. 3 shows the effect of ink viscosity on printing results. When the ink viscosity was increased with the addition of a poly(4-methylstyrene) binder present at 1 weight percent, the printed feature is better resolved and smearing is reduced. The line width is about 110 micrometers. The left side of FIG. 3 shows printed features using the ink of Example 1 without added binder and the right side shows the same printed features with the ink of Example 5 having the polystyrene binder.

Figure 4:
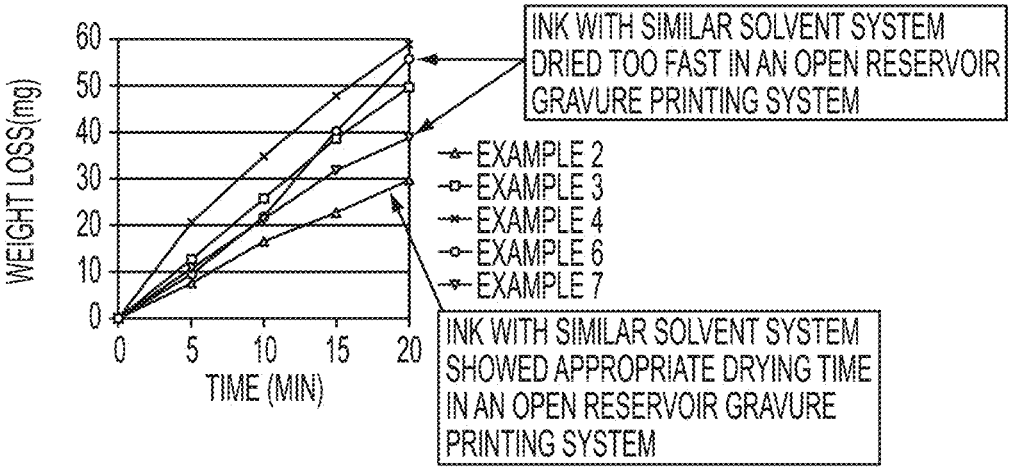
FIG. 4 is a graph showing weight loss (milligrams, y axis) versus drying time (minutes, x axis) for a selection of ink compositions.

FIG. 4 illustrates the effect of the solvent system on ink drying rate. In certain embodiments, the ink solvent is a mixture of decalin (a lower boing solvent) and bicyclohexyl (a high boiling solvent) in various ratios. To assess drying rate, the weight loss (milligrams, y axis) versus time (minutes, x axis) for Ink Examples 2, 3, 4, 6, and 7 are shown in FIG. 4.

Figure 5:
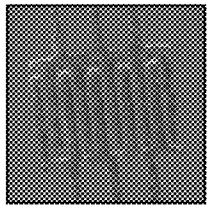
FIG. 5 is a picture showing a first pass and a second pass of a gravure print made with an ink that dried too fast.

Besides the overall viscosity, the solvent drying rate is selected for the desired printer system. Inks having a higher percentage of the lower boiling solvent dried too fast for the investigated printer system. For example, as shown in FIG. 5, a gravure print prepared with the ink of Example 5 and Accupress® 1 from Ohio Gravure Technologies (formerly Daetwyler R&D Corp.) dried too fast and left residues in the engraved cells, leading to inconsistent and degraded features with subsequent prints. An ink having a relatively high boiling point is needed for use with an inking system that is not completely enclosed.

For an enclosed, better sealed inking fixture, the solvent boiling point needs to be reduced and formulated in a range of about 80 to about 190° C. Reduction of the ink boiling point will mitigate drag-out issues during ink transfer, because less ink vapor exists near the transfer nip.

Figure 6:
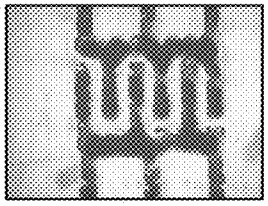
FIG. 6 is a picture showing a first pass and a second pass of a gravure print made with an ink having a relatively high boiling point.
Figure 6:
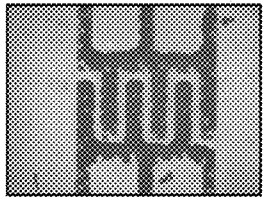

FIG. 6 is a print result using ink Example 9 having a higher boiling point paired with Accupress® 1 from Ohio Gravure Technologies (formerly Daetwyler R&D Corp.) which is a printing system that is not well enclosed.

Figure 7:
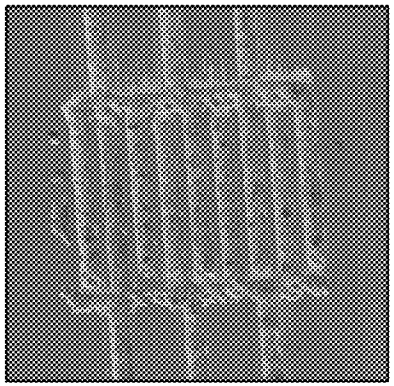
FIG. 7 is a picture of a gravure print made with an ink that dried too slowly resulting in drag-out.

FIG. 7 is a print result using a slow drying ink obtained from Inktec® and sold as ink number TEC-PR-20 and printer system Accupress® 1 from Ohio Gravure Technologies (formerly Daetwyler R&D Corp.). The ink dried too slowly for the printer system, leading to drag-out issues. The line widths for the prints of FIGS. 5, 6, and 7 were about 110 micrometers.

With the ink selected in accordance with the present process to have the appropriate viscosity and boiling point, it was found that the range of printing speed can be from 0.75 m/s to 1.5 m/s although not limited.

Figure 8:
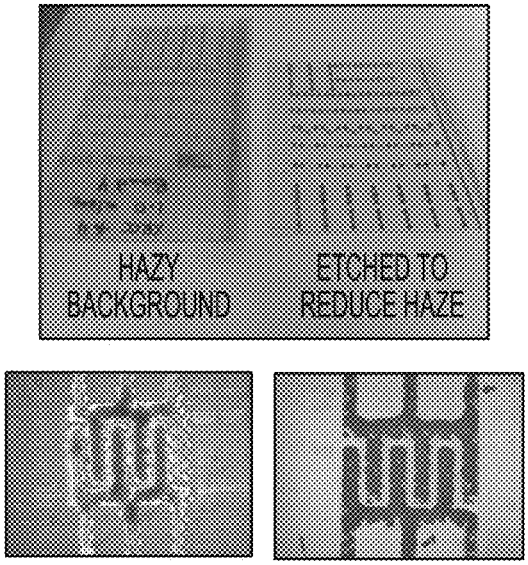
FIG. 8 illustrates printed images before (left) and after (right) an etching step.
Figure 9:
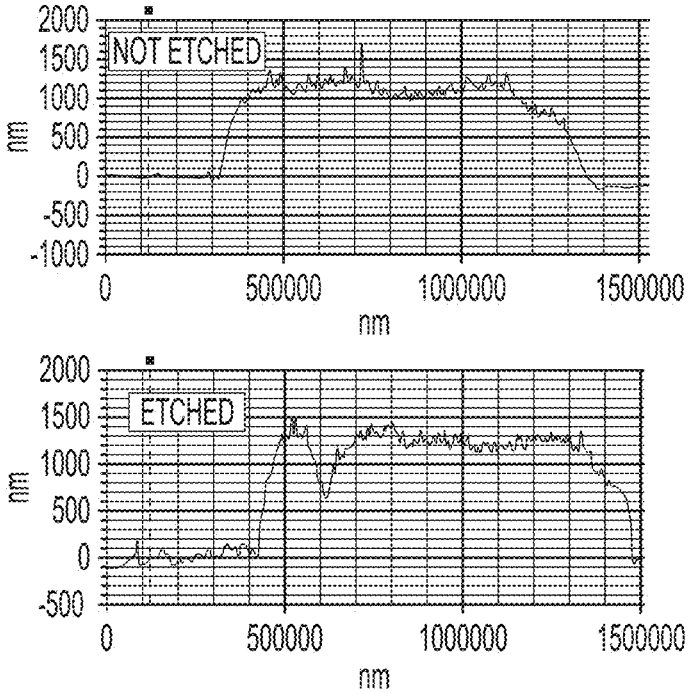
FIG. 9 is a line profile before (top) and after (bottom) an etching step.

For electronic printing, such as patterning of conductor electrodes, any residual haze left behind in the background might lead to shorting failures between the electrodes. In addition to the proper ink properties/printer system matching, post-printing treatments can be used to improve print quality, for example, to remove the haze. In the present process, an additional etching step was used after the gravure printing to completely remove any residual haze. FIG. 8 shows printed images prepared with the ink of Example 9 using Accupress® 1 from Ohio Gravure Technologies (formerly Daetwyler R&D Corp.) gravure printer before (left) and after (right) an etching step. FIG. 8 compares the substrates before and after etch in a dilute Ag etchant diluted by 50×with DI-water. One can see that the residual haze was completely removed, and electrical measurement shows that proper isolation is achieved. This step can be integrated in the roll to roll process, and the electrode surface morphology is not compromised by the etching step as shown in FIG. 9. FIG. 9 illustrates line profile before (top graph) and after (bottom graph) the etching step.

Figure 10:
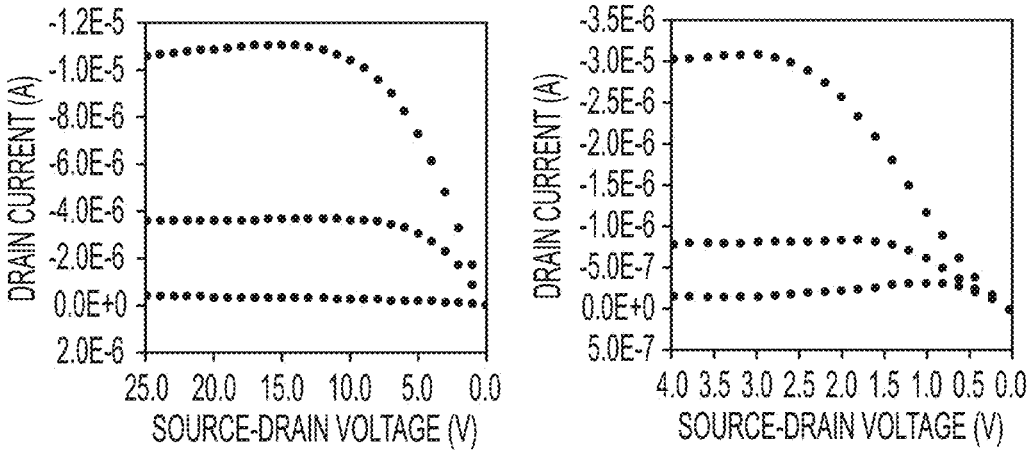
FIG. 10 shows the output curve of p-type transistors with gravure printed source and drain electrodes prepared in accordance with the present process (left) and a comparative device (right).

The printed conductive features were used as electrodes for a transistor application. FIG. 10 shows the output cure of p-type transistors with gravure printed source and drain electrodes prepared in accordance with the present process. No contact resistance was observed. FIG. 10 shows drain current versus source-drain voltage for a thin film transistor (TFT) made from gravure printed source-drain electrodes with amine surfactant (left) and a TFT made from gravure electrodes using other non-Xerox® gravure ink shows contact resistance (right). The gate dielectric constant is larger for the device on the right, and therefore the saturation voltage is smaller than the device on the left.

Thus, the present process encompasses selecting within a range of processing windows, in embodiments tailored for nanoparticle inks based on organic solvent systems. The ink properties were matched to the gravure printer setup to optimize print resolution, reproducibility, and electrical characteristics. While the viscosity of Ag electrode precursor ink is increased with a polymer binder to facilitate better print resolution, the binder does not compromise charge injection. In embodiments, the ink solvent system is matched to the printer reservoir enclosure, to minimize line drag-out while preventing ink clogging in the engraved cells. To eliminate electric shorts between electrodes, a post-printing etching step is employed, which allows higher tolerance on the blade and nip pressure.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A process comprising:

selecting a printing system;

selecting an ink composition having ink properties that match the printing system;

wherein the ink composition comprises metal nanoparticles;

wherein selecting an ink composition having ink properties that match the printing system comprises selecting an ink composition having a boiling point that matches the printing system and having a drying time that matches the printing system;

depositing the ink composition onto a substrate to form an image, to form deposited features, or a combination thereof;

optionally, heating the deposited features to form conductive features on the substrate; and performing a post-printing treatment after depositing the ink composition.

2. The process of claim 1, wherein the printing system is a flexographic printing system or a gravure printing system.

3. The process of claim 1, wherein the post-printing treatment comprises sintering.

4. The process of claim 1, wherein the post-printing treatment comprises etching.

5. The process of claim 1, wherein the printing systems is a gravure printing system, and wherein the post-printing treatment comprises sintering, etching, or a combination thereof.

6. The process of claim 1, wherein selecting an ink composition having ink properties that match the printing system comprises selecting an ink composition having a viscosity that matches the printing system.

7. The process of claim 1, wherein selecting an ink composition having ink properties that match the printing system comprises selecting a printing system having an open enclosure ink reservoir and selecting an ink composition having a drying curve with a slope of more than 2.

8. The process of claim 1, wherein selecting an ink composition having ink properties that match the printing system comprises selecting an ink composition having a relatively high boiling point of from about 200 to about 250° C. for a printing system having an open enclosure ink reservoir.

9. The process of claim 1, wherein selecting an ink composition having ink properties that match the printing system comprises selecting an ink composition having a relatively low boiling point of from about 80 to about 190° C. for a printing system having a closed enclosure ink reservoir.

10. The process of claim 1, wherein selecting an ink composition having ink properties that match the printing system comprises selecting a printing system having a closed enclosure ink reservoir and selecting an ink composition having a drying curve with a slope of less than 1.5.

11. The process of claim 1, wherein the ink composition comprises polystyrene; and an ink vehicle.

12. The process of claim 1, wherein the ink composition comprises polystyrene; and an ink vehicle comprising a mixture of decalin and bicyclohexyl.

13. The process of claim 1, wherein the ink composition comprises a clay dispersion; and an ink vehicle.

14. A process comprising:

selecting a printing system;

selecting an ink composition having ink properties that match the printing system;

wherein selecting an ink composition having ink properties that match the printing system comprises selecting an ink composition having a boiling point that matches the printing system and having a drying time that matches the printing system;

depositing the ink composition onto a substrate to form deposited features;

performing a post-printing treatment after depositing the ink composition; and heating the deposited features to form conductive features on the substrate.

15. The process of claim 14, wherein the post-printing treatment comprises sintering, etching, or a combination thereof.

16. The process of claim 14, wherein selecting an ink composition having ink properties that match the printing system comprises selecting an ink composition having a relatively high boiling point of from about 200 to about 250° C. for a printing system having an open enclosure ink reservoir; or wherein selecting an ink composition having ink properties that match the printing system comprises selecting an ink composition having a relatively low boiling point of from about 80 to about 190 ° C. for a printing system having a closed enclosure ink reservoir.

17. The process of claim 14, wherein the printing system is a flexographic printing system or a gravure printing system.

18. The process of claim 14, wherein selecting an ink composition having ink properties that match the printing system comprises selecting a printing system having an open enclosure ink reservoir and selecting an ink composition having a drying curve with a slope of more than 2; or wherein selecting an ink composition having ink properties that match the printing system comprises selecting a printing system having a closed enclosure ink reservoir and selecting an ink composition having a curve with a slope of less than 1.5.

19. The process of claim 14, wherein the ink composition comprises metal nanoparticles; polystyrene; and an ink vehicle.

20. The process of claim 14, wherein the ink composition comprises metal nanoparticles; a clay dispersion; and an ink vehicle.

* * * * *